United States Patent [19]

Becker

[11] 3,933,535

[45] Jan. 20, 1976

[54] METHOD FOR PRODUCING LARGE AND/OR COMPLEX PERMANENT MAGNET STRUCTURES

[75] Inventor: Joseph J. Becker, Schenectady, N.Y.

[73] Assignee: General Electric Company, Schenectady, N.Y.

[22] Filed: May 12, 1975

[21] Appl. No.: 576,597

Related U.S. Application Data

[63] Continuation of Ser. No. 437,311, Jan. 28, 1974, abandoned.

[52] U.S. Cl. ..... 148/103; 148/31.57; 148/105

[51] Int. Cl.$^2$ ..... H01F 1/02

[58] Field of Search ..... 148/31.57, 103, 105; 310/156; 156/250

[56] References Cited

UNITED STATES PATENTS

| | | | |
|---|---|---|---|
| 2,981,855 | 4/1961 | Lieshout et al. | 310/156 |
| 3,159,517 | 12/1964 | Schornstheimer et al. | 156/250 |
| 3,655,464 | 4/1972 | Benz | 148/101 |

*Primary Examiner*—Walter R. Satterfield

*Attorney, Agent, or Firm*—Jane M. Binkowski; Joseph T. Cohen; Jerome C. Squillaro

[57] ABSTRACT

A method of producing a permanent magnet composite with substantially predetermined magnetic properties and geometry. A number of premagnetized modules of substantially the same size and having substantially the same properties are joined in contact together to produce the permanent magnet composite. Each premagnetized module is characterized by an intrinsic coercive force $H_{ci}$ significantly higher than its ordinary coercive force $H_c$, and is magnetized along its easy axis of magnetization.

4 Claims, 2 Drawing Figures

METHOD FOR PRODUCING LARGE AND/OR COMPLEX PERMANENT MAGNET STRUCTURES

This is a continuation of application Ser. No. 437,311, filed Jan. 28, 1974, now abandoned.

The present invention relates to the art of producing permanent magnets. More particularly, it relates to producing a permanent magnet composite with substantially predetermined magnetic properties and geometry.

When a magnetic field is applied to a permanent magnet material, a magnetization value of M is established therein. The total flux density B includes the contribution of both magnetization M and magnetic field H. When the magnetic field is removed, the material has a remanent flux density $B_r$. The intrinsic coercive force $H_{ci}$ of the permanent magnet is the value of the field within the material, resulting from an externally applied demagnetizing field which reduces its magnetization M to zero. $H_{ci}$ is a measure of a permanent magnet's resistance to demagnetization. On the other hand, ordinary coercive force $H_c$ is the value of the field within the material, resulting from the external demagnetizing field, at which the induction B becomes zero.

Figure 1:
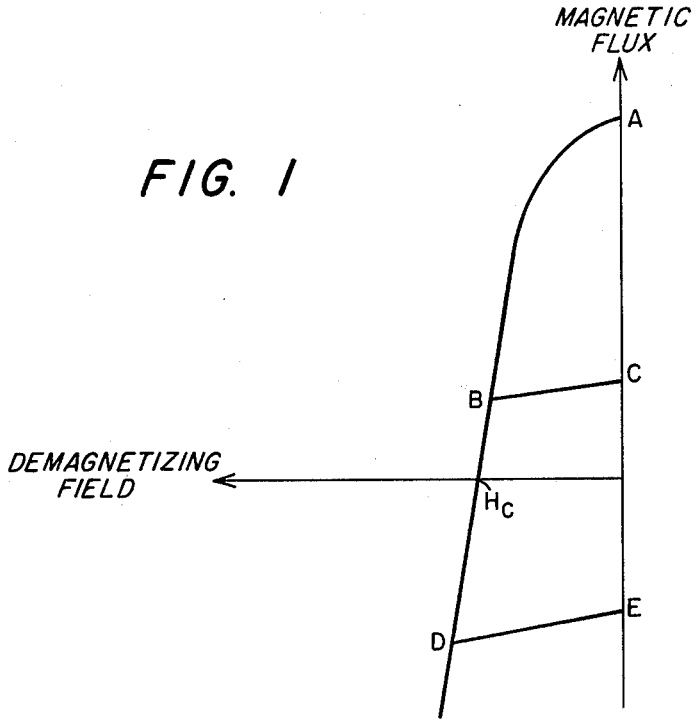
Figure 2:
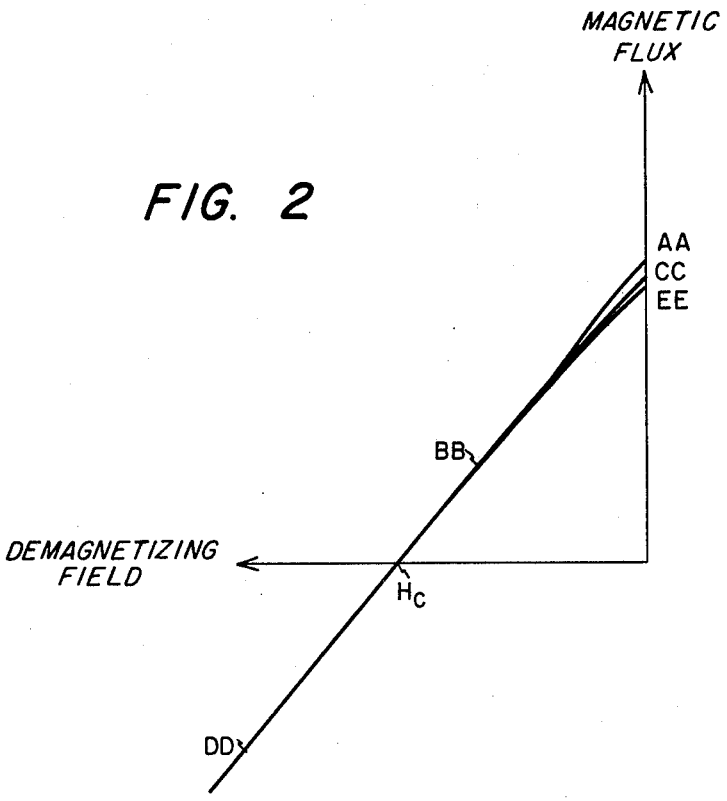

Those skilled in the art will gain a further and better understanding of the present invention from the detailed description set forth below, considered in conjunction with the figures accompanying and forming a part of the specification, in which:

FIG. 1 illustrates demagnetization curves for a permanent magnet material having an intrinsic coercive force $H_{ci}$ approximately equal to ordinary coercive force $H_c$; and FIG. 2 illustrates demagnetization curves for a permanent magnet material of the present invention having an intrinsic coercive force $H_{ci}$ significantly higher than ordinary coercive force $H_c$.

Many conventional permanent magnet materials, such as the Alnicos, have an ordinary coercive force $H_c$ and an intrinsic coercive force $H_{ci}$ that are numerically much smaller than their remanent flux density $B_r$. The demagnetization curve for such a magnet is shown in FIG. 1. Once such a magnet has been subjected to a demagnetizing field, bringing its remanent flux A down to point B in FIG. 1, when the field is removed, the flux will return along the recoil line to point C. A slightly greater demagnetizing field would reverse the flux, for example to point D, and upon recoil the magnet would be left with the reversed flux E. In either case, it would then have to be remagnetized to supply a useful quantity of flux.

There are other permanent magnet materials that are characterized by the intrinsic coercive force $H_{ci}$ being significantly higher than the ordinary coercive force $H_c$. This class of materials includes the cobalt-rare-earths, and frequently includes barium ferrites such as $BaFe_{12}O_{19}$. These materials have the characteristic that the recoil curve is essentially the same as the demagnetization curve. FIG. 2 illustrates this behavior. In such a material, if the remanent flux AA is reduced to BB, or to DD, by a demagnetizing field, it will return to CC or EE, practically identical to the remanence point AA, upon removal of the field. Specifically, the demagnetizing field $H_c$ makes the remanent flux zero by simply cancelling out the flux from the material, without affecting its magnetization M. As soon as the field is remove, the flux is substantially completely regained. That is, the material is not permanently demagnetized even though the flux is driven to zero, or even beyond into negative values as long as it is not driven beyond its intrinsic coercive force value $H_{ci}$.

Cobalt-rare earth intermetallic compounds or alloys exist in a variety of phases. Thus far, cobalt-rare earth alloys containing a substantial amount of $Co_5R$ phase (in each occurrence R designates a rare earth metal) have exhibited the best magnetic properties. To produce a permanent magnet with satisfactory properties, the CoR alloy must be produced as powder which is then usually compressed in an aligning magnetic field to form an aligned pressed-powder compact. Usually, the aligned pressed powder or green compact is sintered to produce a more dense product having more stable properties. A magnetizing field is applied to the sintered body parallel to its easy axis of magnetization, generally at room temperature, to produce a permanent magnet. Permanent magnets of barium ferrites are prepared in substantially the same manner.

A disadvantage of this preparation technique is that large or complex permanent magnet structures cannot be formed or might be formed with difficulty at excessive expense of energy. Specifically, the pressed powder or green compact is limited in size by the pressure required to press the powder into a compact with sufficient strength so that it can be handled without excessive breakage before sintering. Experience indicates that frequently a minimum pressure of about 100,000 psi is needed. Thus, large magnets, for example cylindrical or button shaped magnets with a circular surface area greater than 4–5 square inches, are difficult to make because of the need for presses greater than 200 tons.

The present invention provides a method for forming large and/or complex permanent magnet structures in a practical economical manner and eliminates the need for exorbitant energy requirements and costly equipment. The present method also results in the production of a number of types of magnet structures which have not been possible to produce in the past.

Briefly stated, the present invention is directed to producing a permanent magnet composite with substantially predetermined magnetic properties and geometry. Specifically, the process comprises providing premagnetized modules of substantially the same size and having substantially the same properties, and joining in contact together a number of said premagnetized modules to produce said permanent magnet composite, each said module being premagnetized along its easy axis of magnetization, and being characterized by an intrinsic coercive force $H_{ci}$ significantly higher than its ordinary coercive force $H_c$.

The use of modules of a fixed size and shape in accordance with the present invention provides a number of advantages for magnet manufacture. Identical modules cna be efficiently produced for uniform properties at minimum cost. Having the same size, shape, and nominal properties, they can readily be tested for quality control by simple, effective, and easily automated testing methods. Most importantly, a permanent magnet composite of given specifications can be constructed easily from the present premagnetized modules.

One important source of demagnetizing fields is the shape of the magnet, or of the magnet plus its associated magnetic circuit. Specifically, the shorter the magnet relative to its width, the greater is its self-demagnetizing field. For example, a bar magnet of compacted particulate cobalt-rare earth alloy having an effective length to diameter ratio of one or less than one is not demagnetized by its shape but a bar of Alnico of such same length to diameter ratio is demagnetized by its shape. As a result, the present invention is limited to permanent magnet materials characterized by an intrinsic coercive force $H_{ci}$ at least 30% higher than its ordinary coercive force $H_c$. Representative of the permanent magnet materials useful in the present invention are the cobalt-rare earth alloys, and particularly preferred are those alloys which contain the $Co_5R$ phase (in each occurrence R designates a rare earth metal or metals) in a significant amount.

The rare earth metals useful in forming the present cobalt-rare earth alloys are the 15 elements of the lanthanide series having atomic numbers 57 to 71 inclusive. The element yttrium (atomic number 39) is commonly included in this group of metals and, in this specification, is considered a rare earth metal. A plurality of rare earth metals can also be used to form the present cobalt-rare earth alloys which, for example may be ternary, quartenary or which may contain an even greater number of rare earth metals as desired.

Representative of the cobalt-rare earth alloys useful in the present invention are cobalt-cerium, cobalt-praseodymium, cobalt-neodymium, cobalt-promethium, cobalt-samarium, cobalt-europium, cobalt-gadolinium, cobalt-terbium, cobalt-dysprosium, cobalt-holmium, cobalt-erbium, cobalt-thulium, cobalt-ytterbium, cobalt-lutetium, cobalt-yttrium, cobalt-lanthanum and cobalt-mischmetal. Mischmetal is the most common alloy of the rare earth metals which contains the metals in the approximate ratio in which they occur in their most common naturally occurring ores. Examples of specific ternary alloys include cobalt-samarium-mischmetal, cobalt-cerium-praseodymium, cobalt-yttrium-praseodymium, and cobalt-praseodymium-mischmetal.

FIG. 2 illustrates the resistance to demagnetization of the present permanent magnet material. The fact that the recoil line is almost identical to the demagnetization curve for the magnets of FIG. 2 means that their geometry can be changed at will without the necessity for remagnetization. In particular, any desired size or shape permanent magnet can be constructed of premagnetized building blocks or modules of any convenient size and shape. The final structure, i.e., permanent magnet composite, will have the flux appropriate to its shape.

The present particles of permanent magnet alloy or intermetallic compound can be formed by a number of methods. For example, the particles can be prepared by melting the components together in the proper amounts of a substantially inert atmosphere such as argon, and comminuting the resulting solid alloy to particulate form in a conventional manner. Alternatively, the powder or particles can be produced initially by a reduction-diffusion process as disclosed in U.S. Pat. No. 3,748,193 in the name of Robert E. Cech, and assigned to the assignee hereof, and which by reference is made part of disclosure of the present application. Also, in some instances, it may be desirable to grind sintered compacts of these powders to a desired particle size.

The size of the present permanent magnet powder or particles can vary. They can be in as finely divided a form as desired. For most applications, average particle size will vary from about 1 micron or less to about 10 microns. Large sized particles can be used but the maximum intrinsic coercive force obtainable is lower because it decreases with increasing particle size. The particles or powder are magnetically aligned along their easy or preferred axis of magnetization prior to or during compression since the greater their magnetic alignment the better are the resulting magnetic properties. The aligned powder or particles are pressed to a compact of desired size and shape. Compression can be carried out by a number of conventional techniques such as hydrostatic pressing or methods employing steel dies.

The present module may be a sintered product of compacted particulate permanent magnet alloy or intermetallic compound or a pressed powder compact of such material. Generally, it is a sintered product having substantially non-interconnecting pores which usually requires that the product have a density of at least 87%. Such noninterconnectivity stabilizes magnetic properties because the interior of the product is protected against exposure to the ambient atmosphere. When the present module or building block is an unsintered pressed powder compact, it is pressed to a desired density, usually at least 70%, to give it sufficient mechanical strength for handling. If it is a compact of cobalt-rare earth alloy particles, it is usually provided with a non-magnetic protective coating such as a metal or plastic, for example, zinc or epoxy resin. Alternatively, the permanent magnet powder or particles can be mixed with a suitable non-magnetic matrix such as a metal, plastic, or elastomer, in the desired amounts to produce a module having the desired geometry and magnetic properties, and likewise, the module consisting essentially of non-magnetic matrix and permanent magnet powder or particles, which may also be powder or particles crushed from a sintered body, has a density usually of at least 70% to give it sufficient mechanical strength.

The sintered modules of the present process may be prepared by a number of techniques. Those techniques which are particularly useful in the present invention are disclosed in U.S. Pat. Nos. 3,655,464; 3,655,463; and 3,695,945, all filed in the name of Mark G. Benz, and assigned to the assignee hereof, and all of which by reference are made part of the disclosure of the present application. Each of the aforementioned patents discloses a process for preparing novel sintered cobalt-rare earth intermetallic products which can be magnetized to form permanent magnets having stable improved magnetic properties.

The present modules or building blocks are produced in a form suitable for constructing the particular large or complex permanent magnet structure desired. For example, modules in the form of bricks are particularly suitable for forming a number of types of large structures.

In carrying out the present invention, each module is magnetized along its easy axis of magnetization, and the magnetized modules are joined in contact together to form the desired structure. They may be held in contact by magnetic attraction, but usually, they are held together by external physical means which may or may not be magnetic depending upon the particular results desired. Representative of the external physical means is a strip of metal, or a bonding agent such as an epoxy resin.

The present method is useful for preparing large and/or complex permanent magnet structures for such diverse applications as motors, generators, magnetic separators and microwave devices.

The present invention is further illustrated by the following example.

EXAMPLE

In this example, a large permanent magnet is prepared.

A number of sintered products of compacted particulate cobalt-samarium permanent magnet alloy products having the same composition and a density of 87% are prepared as set forth in U.S. Pat. No. 3,655,464.

These products are in brick form of the same size. Each brick is magnetized in the same manner along its easy axis of magnetization. The magnetized bricks are bonded together by means of an epoxy resin end to end with opposing poles in contact and side to side to form a permanent magnet structure in the form of a wall.

What is claimed is:

1. A method of producing a large and/or complex magnetized permanent magnet structure having a surface area greater than 4 square inches with predetermined magnetic properties and geometry and having a flux determined by its shape and consisting essentially of premagnetized modules comprising forming a powder consisting essentially of a permanent magnet type cobalt-rare earth alloy having an average particle size up to about 10 microns, subjecting said powder to a magnetic field to magnetically align it along its easy axis of magnetization, pressing the aligned powder into a compact having a density of at least 70%, coating said compact with a non-magnetic protective coating selected from the group consisting of a plastic or metal, and magnetizing said coated compact along its easy axis of magnetization producing a premagnetized module, said premagnetized module being characterized by an intrinsic coercive force $H_{ci}$ at least 30% higher than its ordinary coercive force $H_c$, a demagnetization curve substantially in the form of a straight line and a recoil line substantially identical to its demagnetization curve when its remanent flux is driven to zero, producing a plurality of said premagnetized modules of substantially the same size and having substantially the same properties, and bonding together a plurality of said premagnetized modules to produce said magnetized permanent magnet structure, said premagnetized modules being bonded so that only north poles of bonded modules form the surface of the north pole of said magnetized permanent magnet structure and only south poles of bonded modules form the surface of the south pole of said magnetized permanent magnet structure, said bonding always including external physical means.

2. A method of producing a large and/or complex magnetized permanent magnet structure having a surface area greater than 4 square inches with predetermined magnetic properties and geometry and having a flux determined by its shape and consisting essentially of premagnetized modules comprising forming a powder consisting essentially of a permanent magnet type cobalt-rare earth alloy having an average particle size up to about 10 microns, subjecting said powder to a magnetic field to magnetically align it along its easy axis of magnetization, pressing the aligned powder into a compact having a density of at least 70%, sintering said compact to a density of at least 87%, and magnetizing the resulting sintered body along its easy axis of magnetization producing a premagnetized module, said premagnetized module being characterized by an intrinsic coercive force $H_{ci}$ at least 30% higher than its ordinary coercive force $H_c$, a demagnetization curve substantially in the form of a straight line and a recoil line substantially identical to its demagnetization curve when its remanent flux is driven to zero, producing a plurality of said premagnetized modules of substantially the same size and having substantially the same properties, and bonding together a plurality said premagnetized modules to produce said magnetized permanent magnet structure, said premagnetized modules being bonded so that only north poles of bonded modules form the surface of the north pole of said magnetized permanent magnet structure and only south poles of bonded modules form the surface of the south pole of said magnetized permanent magnet structure, said bonding always including external physical means.

3. A method of producing a large and/or complex magnetized permanent magnet structure according to claim 1 wherein said premagnetized modules have an effective length to diameter ratio of one or less than one.

4. A method of producing a large and/or complex magnetized permanent magnet structure according to claim 2 wherein said premagnetized modules have an effective length to diameter ratio of one or less than one.

* * * * *